US006677840B2

(12) United States Patent
Nakamura et al.

(10) Patent No.: US 6,677,840 B2
(45) Date of Patent: Jan. 13, 2004

(54) ELECTROMAGNETIC RELAY

(75) Inventors: Akihiko Nakamura, Tokyo (JP); Shigemitsu Aoki, Tokyo (JP); Yoshio Okamoto, Tokyo (JP); Tomohisa Endoh, Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/903,614

(22) Filed: Jul. 13, 2001

(65) Prior Publication Data

US 2002/0036557 A1 Mar. 28, 2002

(30) Foreign Application Priority Data

Jul. 18, 2000 (JP) ..... 2000-222401
Dec. 8, 2000 (JP) ..... 2000-374314

(51) Int. Cl.[7] ..... H01H 67/02
(52) U.S. Cl. ..... 335/128; 335/83
(58) Field of Search ..... 335/78–86, 124, 335/128, 202

(56) References Cited

U.S. PATENT DOCUMENTS

| | | | | |
|---|---|---|---|---|
| 3,742,405 A | | 6/1973 | Hayden et al. | |
| 4,259,557 A | | 3/1981 | Takano | |
| 4,684,910 A | * | 8/1987 | Dittmann et al. | 335/274 |
| 4,816,794 A | | 3/1989 | Nagao et al. | |
| 4,893,048 A | | 1/1990 | Farrall | |
| 6,057,749 A | | 5/2000 | Doneghue | |

FOREIGN PATENT DOCUMENTS

| | | | |
|---|---|---|---|
| DE | 82 35 283 | | 6/1983 |
| DE | 3545356 | A1 | 6/1987 |
| DE | 19715914 | C1 | 4/1997 |
| EP | 0 094 045 | A2 | 11/1983 |
| EP | 0 303 054 | A2 | 2/1989 |
| EP | 0 982 746 | A2 | 3/2000 |
| JP | 7-65685 | | 3/1995 |
| JP | 10-134692 | * | 10/1998 |
| JP | 2000-299046 | | 10/2000 |

* cited by examiner

*Primary Examiner*—Lincoln Donovan
(74) *Attorney, Agent, or Firm*—Staas & Halsey LLP

(57) ABSTRACT

An electromagnetic relay of a simple structure for reliably making and breaking a high load voltage. First and second fixed contact terminals are mounted on an insulating base block. First and second branched moving pieces are attached to the lower side of a hanging portion of a spring member. When a relay coil is not excited, the first and second moving pieces are resiliently urged into contact with a back-stop plate, displaced from the first and second fixed contact elements. When the relay coil is excited, contact elements attached to the first and second moving pieces are resiliently urged into contact with respective contact elements attached to the first and second fixed contact elements, electrically connecting the respective first and second fixed contact terminals.

45 Claims, 14 Drawing Sheets

ELECTROMAGNETIC RELAY

BACKGROUND OF THE INVENTION

1. Field of the Invention

The present invention relates to an electromagnetic relay.

2. Description of the Related Art

An electromagnetic relay is used for making and breaking a load voltage. In order to reliably make and break high load voltages, however, attempts have been made to open and close the contact point by using a motor as disclosed in Japanese Unexamined Patent Publication (Kokai) No. 65685/1995. However, the device of the above publication has a complex structure and is expensive. It has therefore been attempted to connect plural electromagnetic relays each having a pair of contact terminals in series (see FIG. 18) or to connect the contact terminals in series inside an electromagnetic relay that has plural contact terminals (see FIG. 19).

Even in the above-mentioned case, however, defects are involved such as an increased number of steps for forming wiring to make a connection among plural connection terminals, an increase in the length of current-flow path in the relay which generates greater heat, and use of plural electromagnetic relays or of an electromagnetic relay having plural contact terminals which drives up the cost and makes it difficult to decrease the size.

SUMMARY OF THE INVENTION

In view of the above-mentioned problems, it is an object of the present invention to provide a relay of a simple structure capable of reliably making and breaking high load voltages.

According to the present invention, there is provided an electromagnetic relay which comprises a first fixed contact terminal and a second fixed contact terminal spaced from each other on one surface of a base block, fixed conductor pieces, in a number n−1, mounted on said one surface of said base block in alignment with and between the first fixed contact terminal and the second fixed contact terminal, and moving conductor pieces, in a number n, formed by or supported by cantilevered spring members that are simultaneously moved by one or plural coils mounted on said base block, for connecting the first fixed contact terminal, the second fixed contact terminal and the two neighboring fixed conductor pieces simultaneously in a crosslinked manner, wherein the first fixed contact terminal and the second fixed contact terminal are connected together through serially arranged contact sets of a number of 2n formed by the first fixed contact terminal, second fixed contact terminal, fixed conductor pieces of the number of n−1 and moving conductor pieces of the number of n, while n is an integer of not smaller than 1.

The thus constituted electromagnetic relay realizes the making and breaking of a voltage on a base block through plural serial contact sets.

The present invention may be more fully understood from the description of preferred embodiments of the invention set forth below, together with the accompanying drawings.

BRIEF DESCRIPTION OF THE DRAWINGS

FIG. 17*a* & 17*b* are view illustrating how to mount the contact elements, wherein FIG. 17*a* illustrates a case of the present invention, and FIG. 17*b* illustrates a case according to a prior art;

Embodiments of the invention will now be described with reference to the accompanying drawings.

Figure 1:
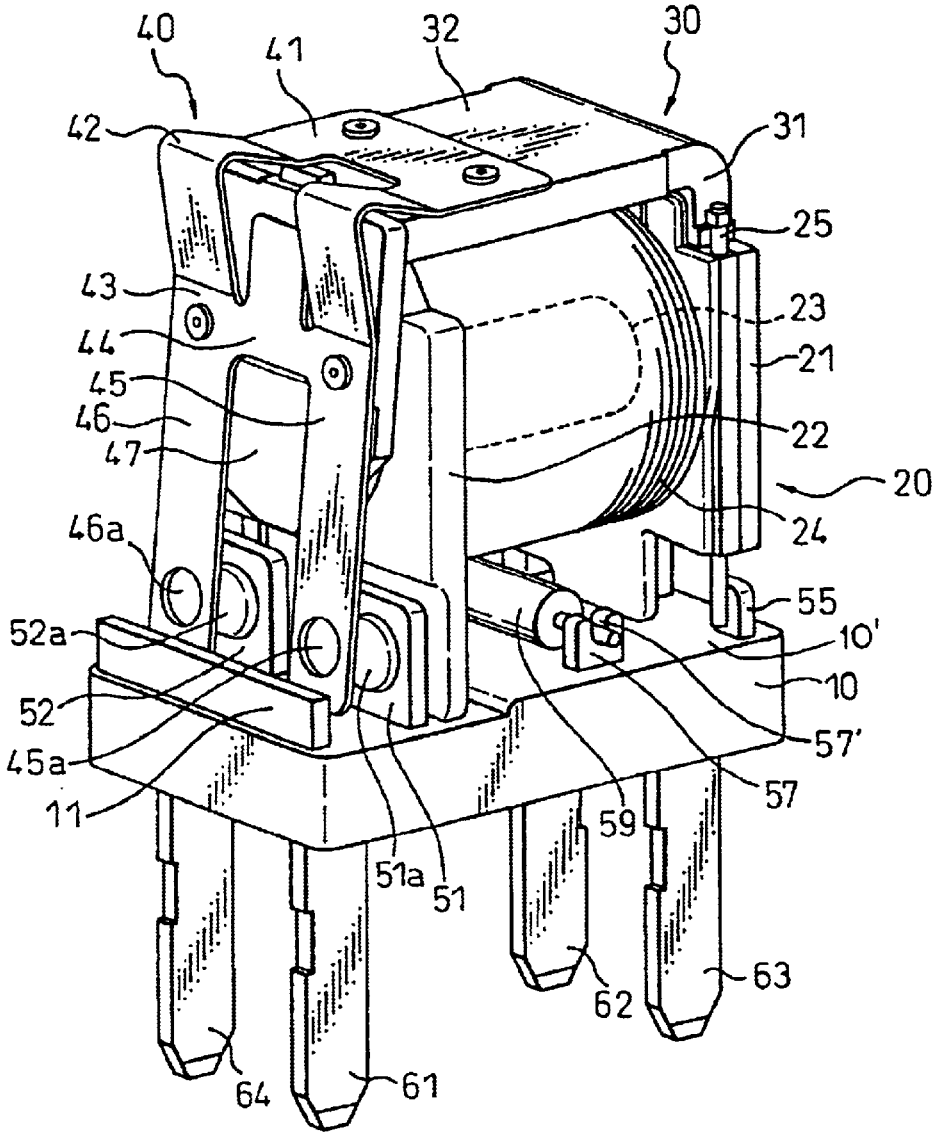
FIG. 1 is a perspective view of a first embodiment.
Figure 2:
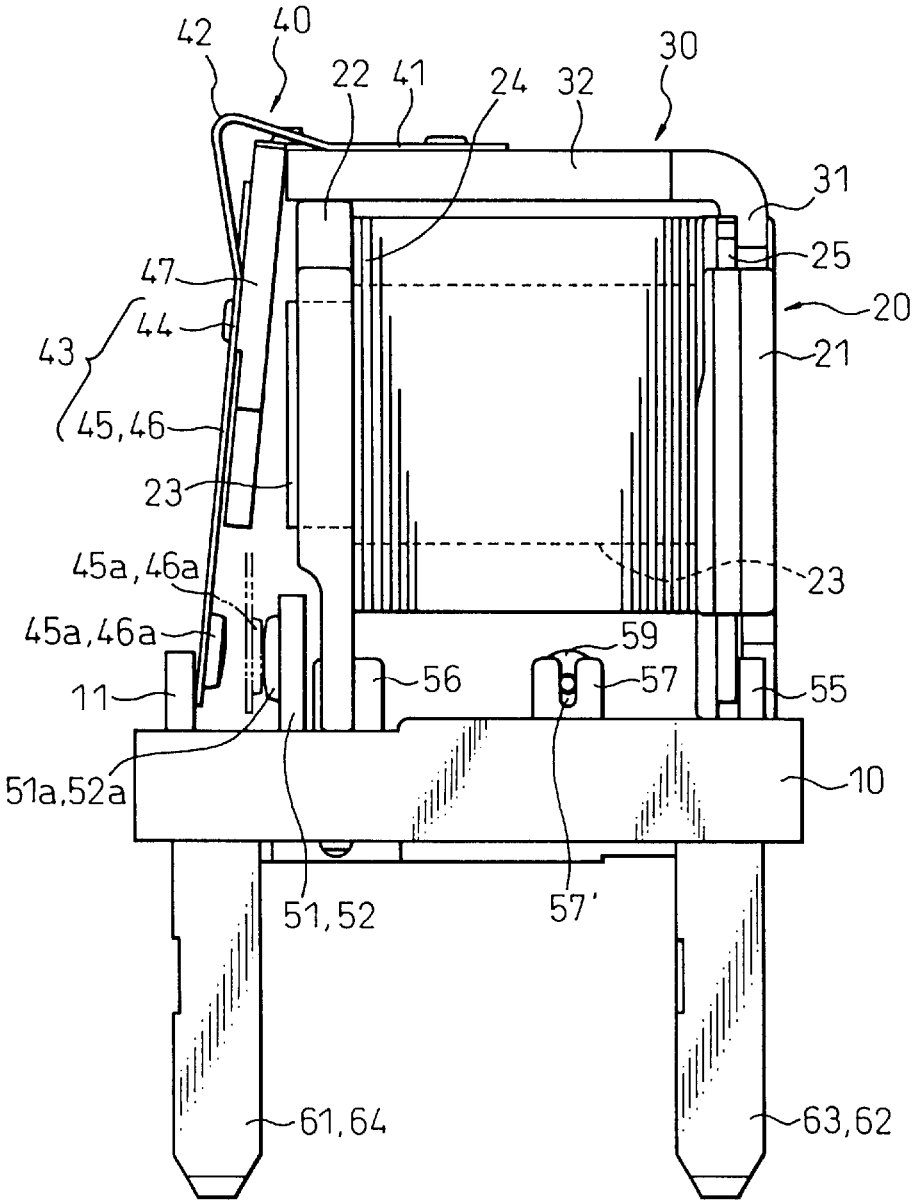
FIG. 2 is a side view of the first embodiment.
Figure 3:
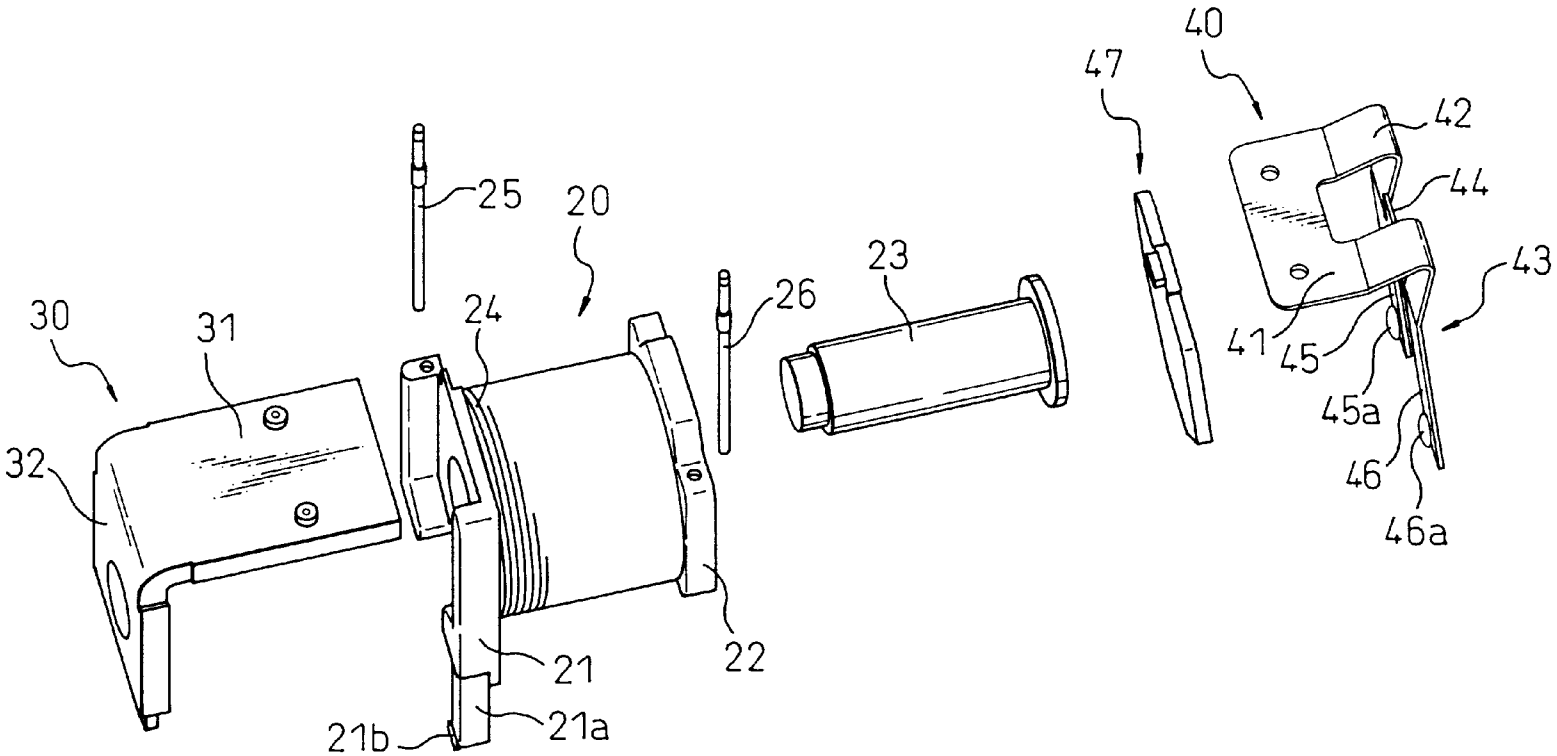
FIG. 3 is a disassembled view of the first embodiment.
Figure 4:
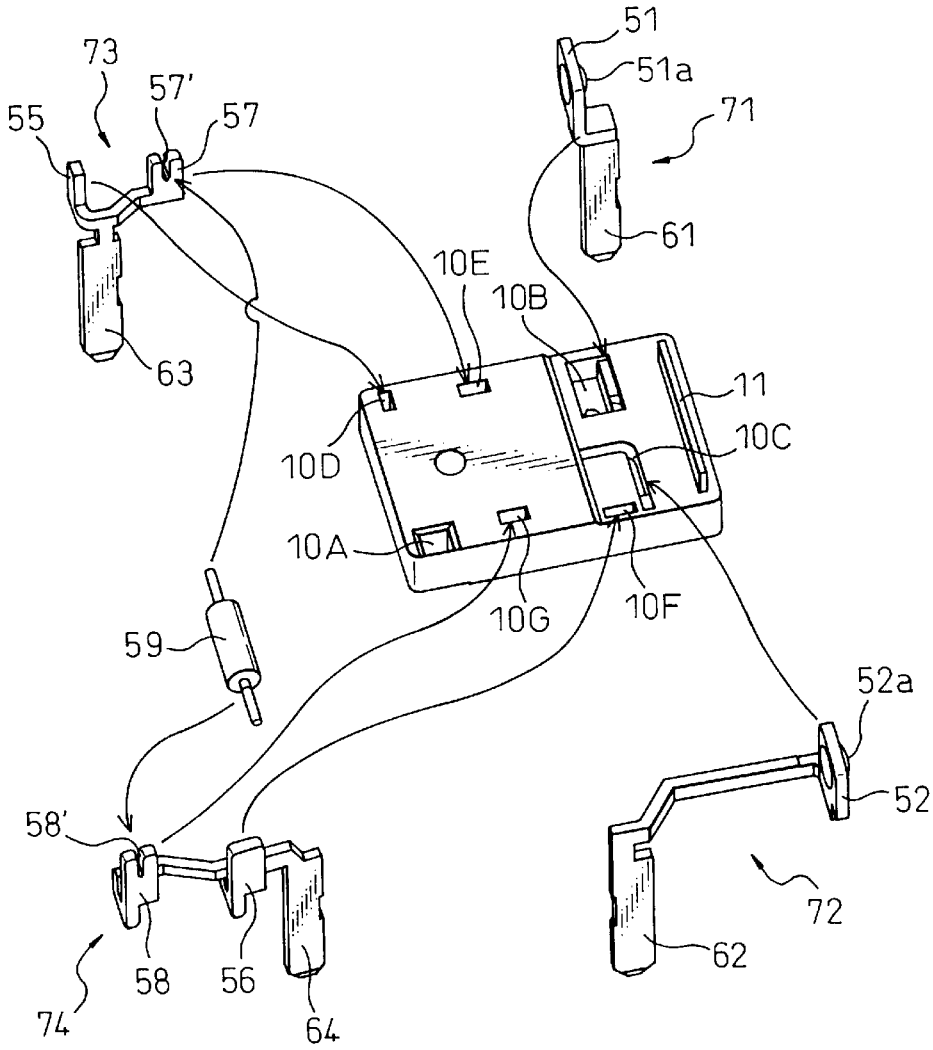
FIG. 4 is a disassembled view of the first embodiment.

FIG. 1 is a perspective view illustrating a state where a cover is removed from an electromagnetic relay of a first embodiment, FIG. 2 is a side view thereof, and FIGS. 3 and 4 are disassembled views thereof.

Referring to the drawings, a first side wall portion 21 and a second side wall portion 22 of a bobbin 20 are secured to a plastic base block 10, as will be described later, and a vertical portion 31 of an L-type yoke 30 is secured to the first side wall portion 21 of the bobbin 20. A horizontal portion 41 of a spring member 40 is attached by, e.g., rivets, to a horizontal portion 32 of the yoke 30, and a hanging portion 43 continues to the horizontal portion 41 of the spring member 40 via a folded portion 42, the hanging portion 43 extending downward to form a moving conductor piece. An armature 47 made of a magnetic material is attached by caulking to an upper portion 44 of the hanging portion 43.

The lower portion, in a position where the armature 47 is attached to the hanging portion 43 of the spring member 40, is branched into two to form a first arm 45 and a second arm 46. Though the branched shape is not an absolute requirement, it is possible to set suitable spring constants relying on the branched shape and to accomplish the action with a weak magnetic force and, hence, to decrease the amount of electric power consumed by the coil.

Contact elements 45*a*, 46*a* made of a material having an excellent arc-resistance property are attached to the first arm 45 and to the second arm 46. The back surfaces of the protruded portions of the contact elements 45*a* and 46*a* are scraped out to reduce the material cost.

A first fixed contact terminal 51 and a second fixed contact terminal 52 are mounted on the base block 10, and have contact elements 51*a* and 52*a* attached thereto. The first fixed contact terminal 51 and the second fixed contact terminal 52 are integrally connected to a first lead terminal 61 and to a second lead terminal 62 which are extending from the lower side of the base block 10 in the drawing and to which the external conductors (not shown) are coupled, in a manner which will be described later.

The bobbin 20 has an iron core 23 arranged on the inside of a cylindrical portion that is not shown, has a coiled conductor 24 wound on the outer side thereof, and forms a coil C together therewith. An end of the coiled conductor 24 is coupled to an upper portion of a conductor pin 25 mounted on a first side wall 21 of the bobbin 20, and a lower end of the conductor pin 25 is contacted to a first coil terminal 55 mounted on the base block 10, the first coil terminal 55 being integrally formed with a third lead terminal 63 which is extending from the lower side of the base block 10 as shown and to which the external conductor (not shown) is coupled, in a manner which will be described later.

Similarly, the other end of the coiled conductor 24 is coupled to an upper portion of a conductor pin 26 (see FIG. 3) mounted on a second side wall 22 of the bobbin 20, a lower end of the conductor pin 26 is contacted to a second coil terminal 56 mounted on the base block 10, the second coil terminal 56 being integrally formed with a fourth lead terminal 64 which is extending from the lower side of the base block 10 as shown and to which the external conductor (not shown) is coupled, in a manner as will be described later.

Further, a third coil terminal 57 having a slot 57*a* is formed integrally with the third lead terminal 63 and, similarly, a fourth coil terminal 58 having a slot 58*a* is formed integrally with the fourth lead terminal 64. Both ends of a protector element 59 are attached into the slots 57*a,* 58*a* so that an excess current will not flow through the coil C.

When a current is supplied to the third lead terminal 63 and the fourth lead terminal 64 and the coil C is excited, the armature 47 is attracted to the side of the coil C, and the first arm 45 and the second arm 46 of the spring member 40 move to the side of the coil C, too.

As the coil C is excited and the spring member 40 moves toward the coil C, the contact elements 45*a* and 46*a* of the first arm 45 and of the second arm 46 come into contact with the contact elements 51*a,* 52*a* of the first fixed contact terminal 51 and of the second fixed contact terminal 52.

Therefore, when a voltage is applied to, for example, the first lead terminal 61, an electric current flows through the first lead terminal 61, the first fixed contact terminal 51, the contact element 51*a,* the contact element 45*a,* the first arm 45, the upper portion 44 of hanging portion 43 of spring member 40, the second arm 46, the contact element 46*a,* the contact element 52*a,* the second fixed contact terminal 52 and the second lead terminal 62. The first pair of contact elements 45*a* and 51*a* form a first contact set CS1 and the second pair of contact elements 46*a* and 52*a* form a second contact set CS2, each of which sets can be spaced apart from each other, as shown by solid lines in FIG. 5, or can be engaged, completing electrical connections therebetween as shown by phantom lines in FIG. 5. Thus, the electric current flows through two contact sets CS1 and CS2, and the time for which the arc continues becomes shorter than that of when a single contact set is employed. When the contact gap is the same as that of the single contact set, therefore, the contact portion exhibits improved durability. When the contact gap is narrowed, the electromagnetic relay consumes less electric power.

Figure 5:
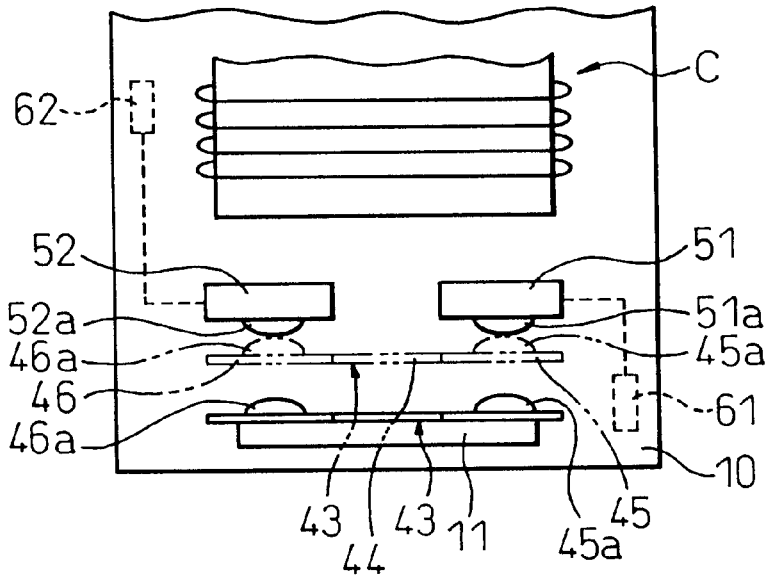
FIG. 5 is a diagram illustrating the operation of contact points of the first embodiment.
Figure 6:
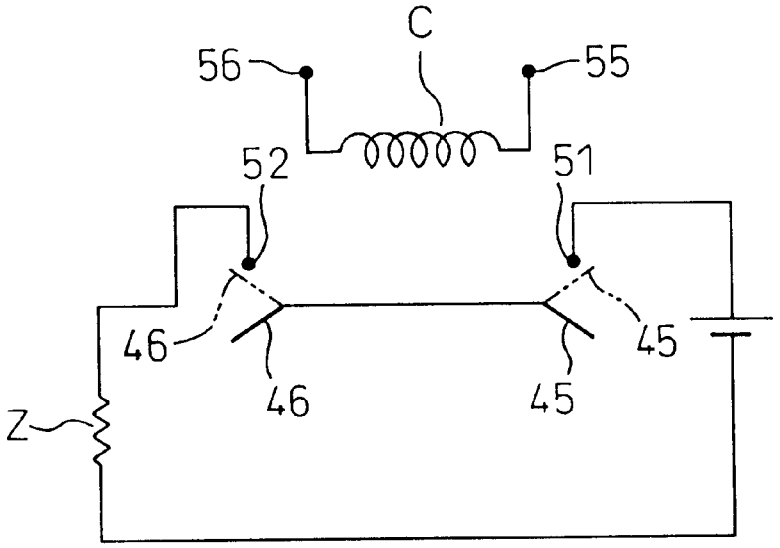
FIG. 6 is a circuit diagram of the first embodiment.

FIG. 5 is a top view schematically illustrating the flow of electricity, and FIG. 6 is a circuit diagram. In FIG. 6, symbol Z denotes a load such as motor.

A back-stop plate 11 is molded with a resin integrally with the base block 10. When the coil C has not been excited, the first arm 45 and the second arm 46 of the spring member 40 come into contact with the back-stop plate 11 and their positions are determined.

The back-stop plate 11 made of a resin is softened or is melted when the current is not completely broken and heat is generated due to arcing in a state where the first arm 45 and the second arm 46 are brought into contact with the back-stop plate 11 without exciting the coil C. Then, the first arm 45 and the second arm 46 move away from the first and second fixed contact terminals 51, 52 due to their own resilient force. Accordingly, the arc ceases and the area of burning does not spread much. When the back-stop plate 11 is formed of a metal, on the other hand, the arc continues to take place because the back-stop plate 11 does not melt, and the area of burning spreads.

A production method according to the first embodiment will be further described with reference to FIGS. 3 and 4.

The conductor pins 25 and 26 for passing an electric current to the coil C are insert-molded in the first side wall 21 and in the second side wall 22 of the bobbin 20.

The bobbin 20 is secured to the base block 10 with its first foot portion 21*a* formed integrally with the first side wall 21 and second foot portion (not shown) formed integrally with the second side wall 22 being inserted in holes 10A, 10B of the base block 10, and with its pawl 21*b* formed at the lower end of the first foot portion 21*a* being engaged with the lower surface of the base block 10.

As described earlier, the first fixed contact terminal 51 is molded integrally with the first lead terminal 61 to thereby form a first fixed contact terminal assembly 71 as shown in FIG. 4. The first fixed contact terminal assembly 71 is secured to the base block 10 with its first fixed contact terminal 51 being so insert-molded as to be located in the hole 10*b* of the base block 10.

As described earlier, the second fixed contact terminal 52 is formed integrally with the second lead terminal 62 to thereby form a second fixed contact terminal assembly 72 as shown in FIG. 4. The second fixed contact terminal assembly 72 is secured to the base block 10 with its second fixed contact terminal 52 being so insert-molded as to be located in the hole 10*b* of the base block 10.

As described earlier, the first coil terminal 55 is formed integrally with the third lead terminal 63 and the third coil terminal 57 to thereby form a first coil terminal assembly 73 as shown in FIG. 4. The first coil terminal assembly 73 is secured to the base block 10 with its first coil terminal 55 and third coil terminal 57 being insert-molded so as to be positioned in the holes 10*d,* 10*e* of the base block 10.

As described earlier, the second coil terminal 56 is formed integrally with the fourth lead terminal 64 and the fourth coil terminal 58 to thereby form a second coil terminal assembly 74 as shown in FIG. 4. The second coil terminal assembly 74 is secured to the base block 10 with its second coil terminal 56 and fourth coil terminal 58 being insert-molded so as to be positioned in the holes 10*f,* 10*g* of the base block 10.

The base block 10 shown in FIG. 4 has not been molded in a shape as described above. From the standpoint of explanation, the base block 10 shown in FIG. 4 shows the mounting positions in a finished state without, however, mounting the terminals.

According to the first embodiment constituted as described above, the electromagnetic relay having two serial contact sets is realized without executing the wiring operation, to suppress the cost, and in a small size.

Figure 7:
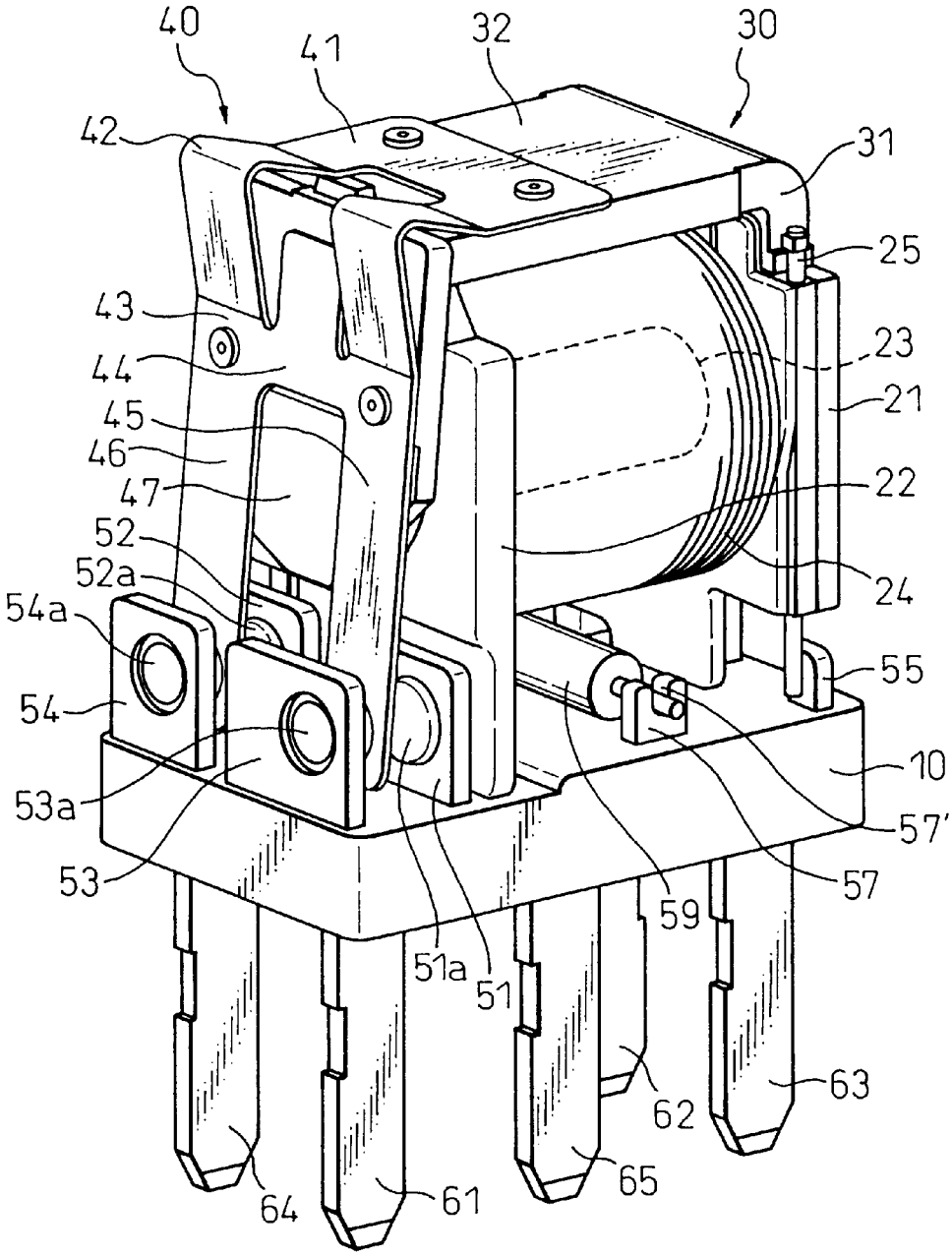
FIG. 7 is a perspective view of a second embodiment.
Figure 8:
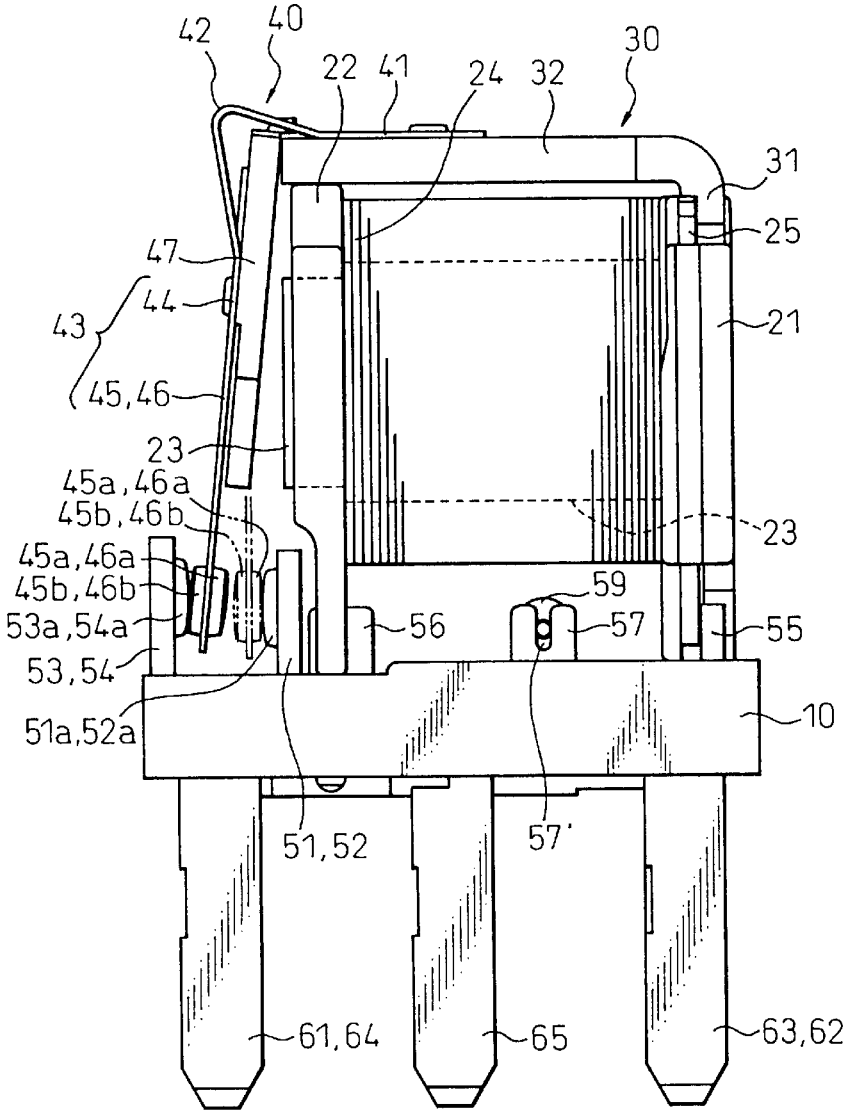
FIG. 8 is a side view of the second embodiment.

Next, a second embodiment will be described. FIG. 7 is a perspective view of the second embodiment, and FIG. 8 is a side view thereof.

In the second embodiment, a third fixed contact terminal 53 and a fourth fixed contact terminal 54 are disposed facing the first fixed contact terminal 51 and the second fixed contact terminal 52 with the first arm 45 and the second arm 46 sandwiched therebetween. Contact elements 53*a* and 54*a* are attached to the third fixed contact terminal 53 and to the fourth fixed contact terminal 54. Further, contact elements 45*b* and 46*b* are attached to the first arm 45 and to the second arm 46 on the back side of the contact elements 45*a* and 46*a*.

Figure 9:
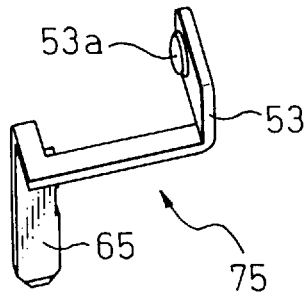
FIG. 9 is a perspective view of a part of the second embodiment.
Figure 10:
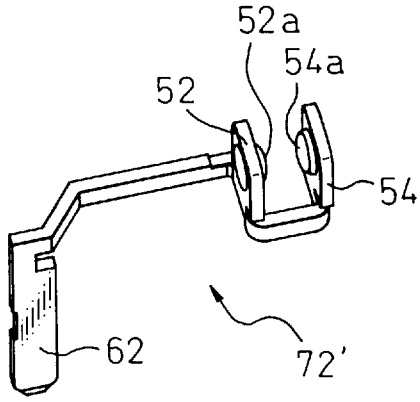
FIG. 10 is a perspective view of a part of the second embodiment.
Figure 11:
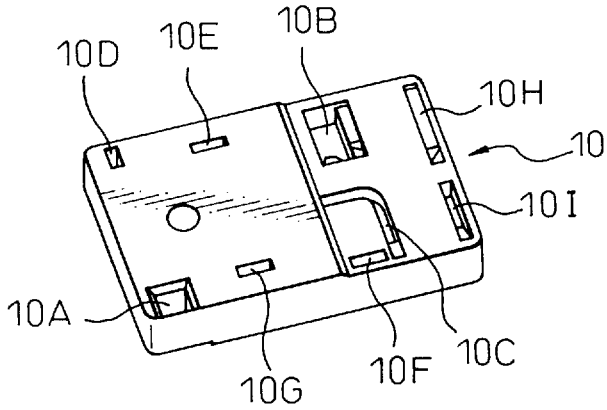
FIG. 11 is a perspective view of a part of the second embodiment.

Referring to FIG. 9, the third fixed contact terminal 53 is molded integrally with a fifth lead terminal 65 to form a third fixed terminal assembly 75. Referring to FIG. 10, the fourth fixed contact terminal 54 is formed integrally with the second fixed contact terminal 52 and the second lead terminal 62 to form a second fixed contact assembly 72'.

Holes 10*h* and 10*i* are formed in the base block 10. The third fixed contact terminal assembly 75 is so insert-molded that the third fixed contact terminal 53 is positioned in the hole 10*h*, and the second fixed contact assembly 72' is so insert-molded that the second fixed contact terminal 52 is positioned in the hole 10*c* and the fourth fixed contact terminal 54 is positioned in the hole 10*i*.

The third fixed contact terminal 53 works as a break contact terminal, and the fourth fixed contact terminal 54 works as a common contact terminal. The first fixed contact terminal 51 and the second fixed contact terminal 52 are a make contact terminal and a common contact terminal, respectively, as in the first embodiment.

Figure 12:
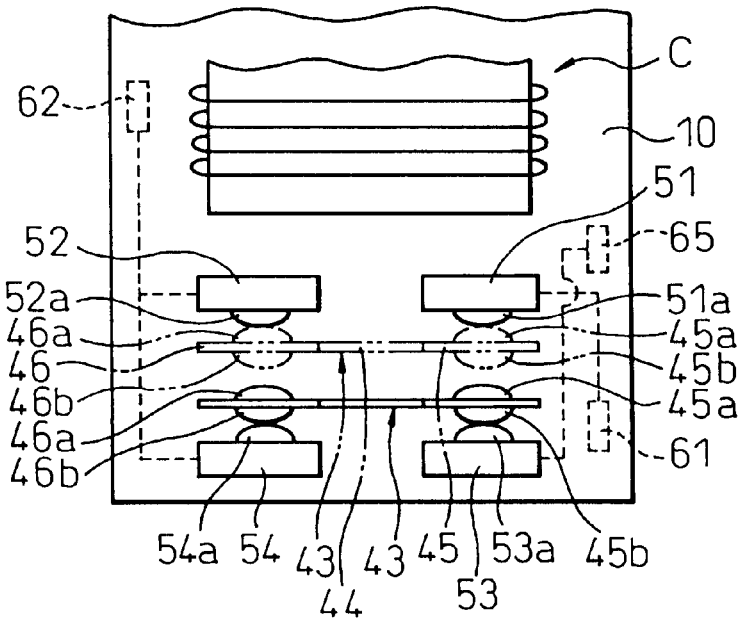
FIG. 12 is a diagram illustrating the operation of contact points of the second embodiment.
Figure 13:
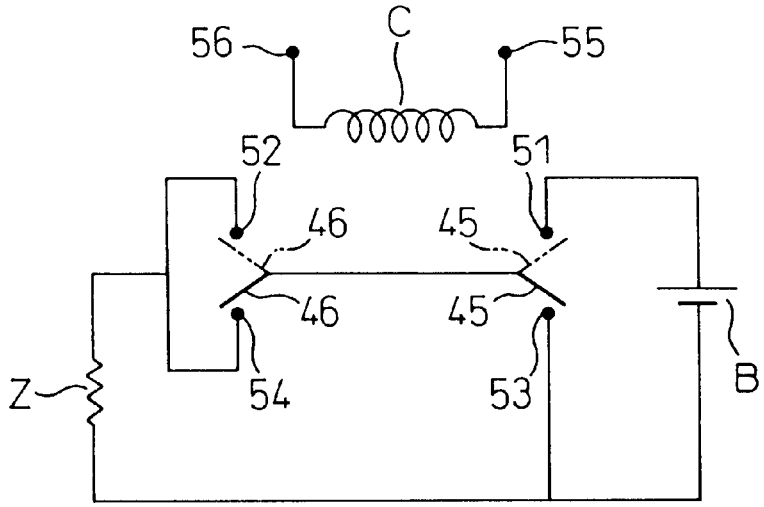
FIG. 13 is a circuit diagram of the second embodiment.

FIGS. 12 and 13 are a schematic view and a circuit diagram illustrating the operation like FIGS. 5 and 6 of the first embodiment. The electric current supplied to the load flows in the same manner as in the first embodiment.

As will be obvious from FIG. 8, the height of the contact elements 53*a*, 54*a* of the third fixed contact terminal 53 and of the fourth fixed contact terminal 54 from the base block is larger than the height of the contact elements 51*a*, 52*a* of the first fixed contact terminal 51 and of the second fixed contact terminal 52 from the base block. This is because the contact elements 45*a*, 46*a* of the first arm 45 and of the second arm 46 come into contact with the contact elements 51*a*, 52*a* of the first fixed contact terminal 51 and of the second fixed contact terminal 52 when the first arm 45 and the second arm 46 are directed downward nearly vertically, whereas the contact elements 45*b*, 46*b* of the first arm 45 and of the second arm 46 come into contact with the contact elements 53*a*, 54*a* of the third fixed contact terminal 53 and of the fourth fixed contact terminal 54 when the first arm 45 and the second arm 46 are tilted. Then, a stable contact is obtained between the contact elements, and the circuit can be reliably made and broken even for high voltages.

Figure 14:
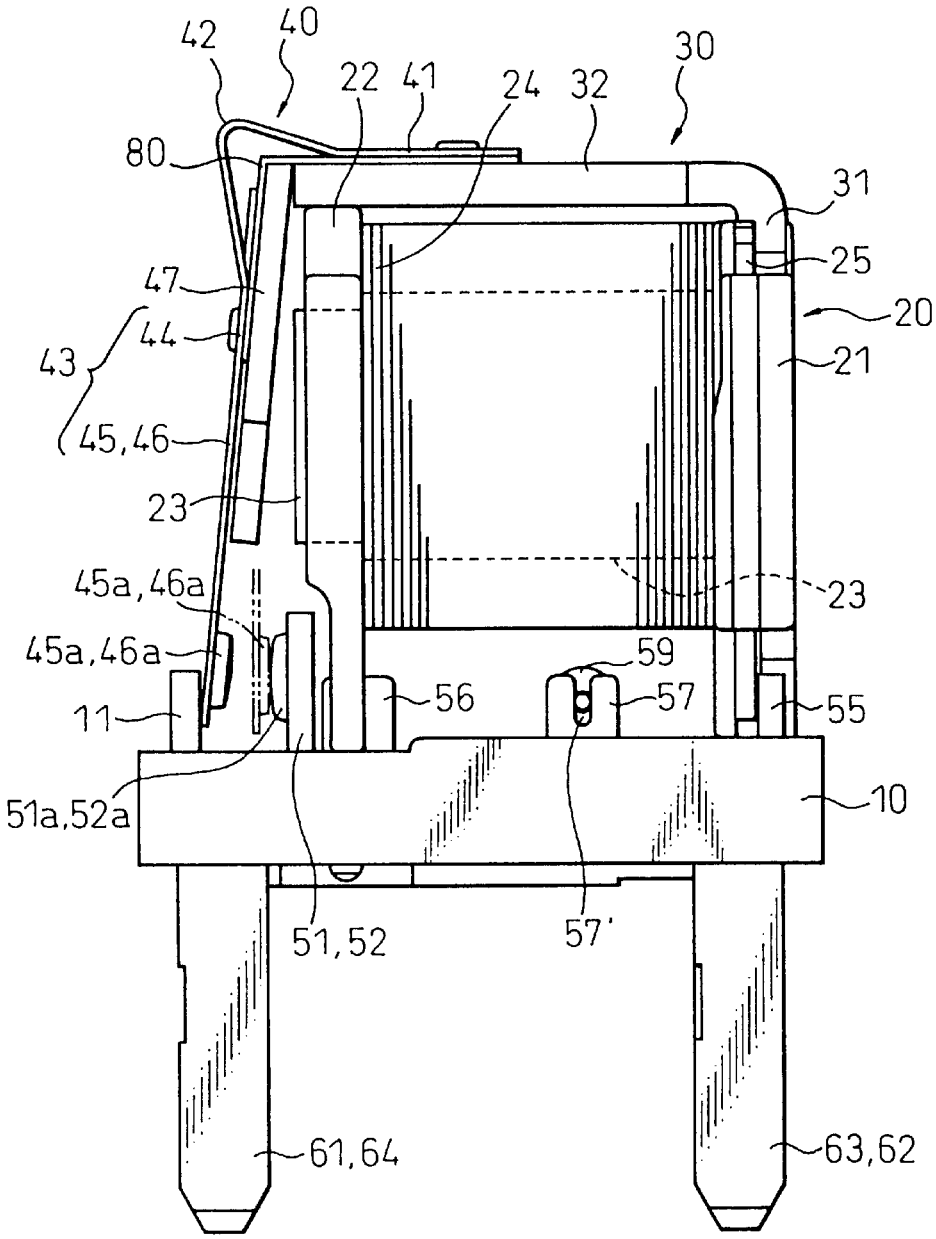
FIG. 14 is a side view of a third embodiment.

Next, described below is a third embodiment. FIG. 14 is a side view illustrating an electromagnetic relay of the third embodiment. In the third embodiment, in comparison with the first embodiment, an electrically insulating member 80 is interposed between the horizontal portion 32 of the yoke 30 and the horizontal portion 41 of the spring member 40, and between the hanging portion 43 of the spring member 40 and the armature 47. Therefore, the electric current is prevented from flowing into the yoke 30 and the armature 47; i.e., the current carrying portion decreases and less heat is generated. The armature 47 is attached to the hanging portion 43 of the spring member 40 by an electrically insulating fastening fitting.

Figure 15:
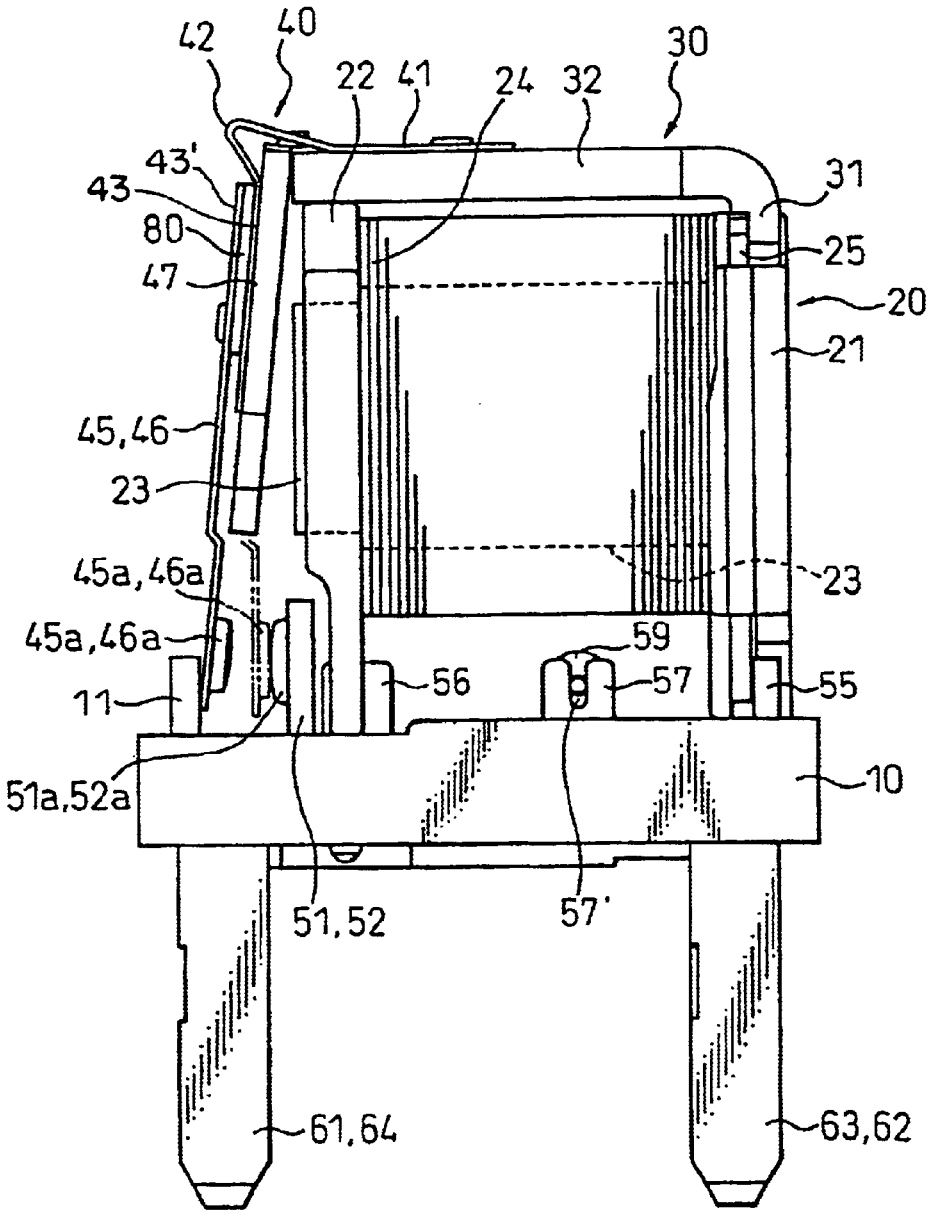
FIG. 15 is a side view of a fourth embodiment.

Next, described below is a fourth embodiment. FIG. 15 is a side view illustrating an electromagnetic relay of the fourth embodiment. In the fourth embodiment, in comparison with, the first embodiment, the hanging portion 43 of the spring member 40 is terminated nearly at the end of the armature 47, the electrically insulating member 80 is overlapped on the hanging portion 43, and a sub-hanging portion 43' is overlapped on the electrically insulating member 80. Then, the hanging portion 43, the electrically insulating member 80 and the sub-hanging potion 43' are all secured to the armature 47 by using an electrically insulating fastening fitting, and the lower side of the sub-hanging portion 43' is branched into two to form the first arm 45 and the second arm 46. Therefore, the current carrying portion is further decreased to generate even less heat.

The third and fourth embodiments can be applied even to the second embodiment.

Figure 16:
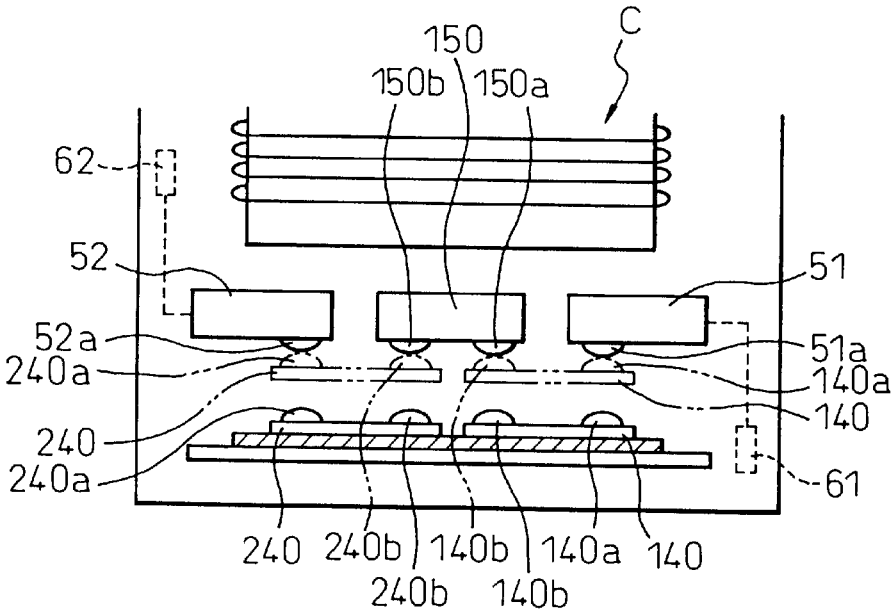
FIG. 16 is a view illustrating the operation of contact points of a fifth embodiment.

Next, described below is a fifth embodiment, as shown in FIG. 16. In the fifth embodiment, a fixed conductor piece 150 is disposed between the first fixed contact terminal 51 and the second fixed contact terminal 52 of the first embodiment, and contact elements 150*a* and 150*b* are attached to near both ends of the fixed conductor piece 150. Further, a first separate moving piece 140 and a second separate moving piece 240 separated from each other through the insulating member 80 are attached to the hanging portion 43 of the spring member 40. The first separate moving piece 140 and the second separate moving piece 240 are branched into two, respectively. The first separate moving piece 140 has, attached thereto, a contact element 140*a* that comes in contact with the contact element 51*a* of the first fixed contact terminal 51 and a contact element 140*b* that comes in contact with the contact element 150*a* of the fixed conductor piece 150, and the second separate moving piece 240 has, attached thereto, a contact element 240*a* that comes in contact with the contact element 52*a* of the second fixed contact terminal 52 and a contact element 240*b* that comes in contact with the contact element 150*b* of the fixed conductor piece 150.

When the coil C is excited, therefore, an electric current flows through the first lead terminal 61; the first fixed contact terminal 51, the contact element 51*a*, the contact element 140*a*, the first separate moving piece 140, the contact element 140*b*, the contact element 150*a*, the fixed conductor piece 150, the contact element 150*b*, the contact element 240*b*, the second separate moving piece 240, the contact element 240*a*, the contact element 52*a*, the second fixed contact terminal 52 and the second lead terminal 62. Thus, the electric current flows through four contact sets, the time in which the arc continues is further shortened, and the resistance against the arc is further improved.

The fifth embodiment has dealt with the case where only one fixed conductor piece was used. Similarly, however, it is also allowable to increase the number of the fixed conductor pieces.

The effect of the serial arrangement is lost if the contact sets are closed and opened in a dispersed manner. It is therefore desired that the contact sets are so controlled as to be closed or opened all within a predetermined period of time, e.g., within 0.1 ms. Concretely speaking, this is done by controlling the spring constant of the spring member that is a material forming the moving conductor pieces.

This holds true even when there is no fixed conductor piece as in the first through fourth embodiments or even when there are many fixed conductor pieces.

Figure 17A:
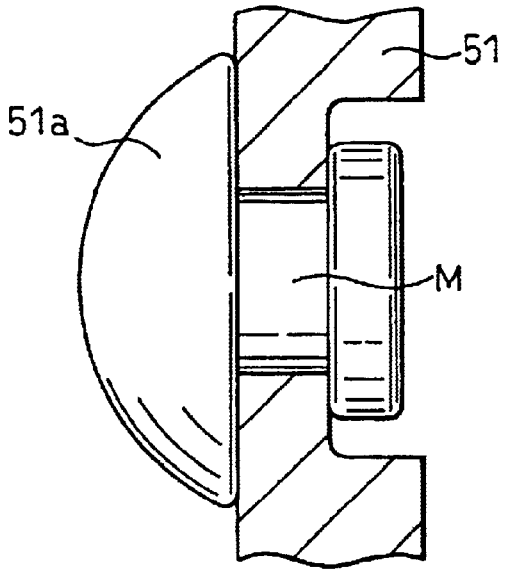
Figure 17B:
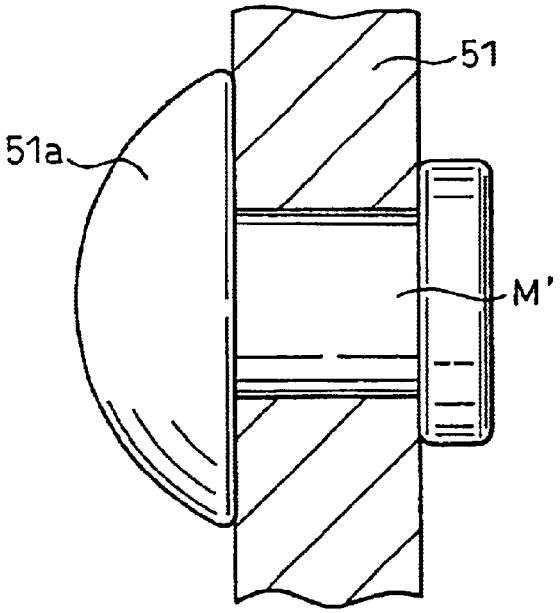
Fig.17b PRIOR ART
Figure 18:
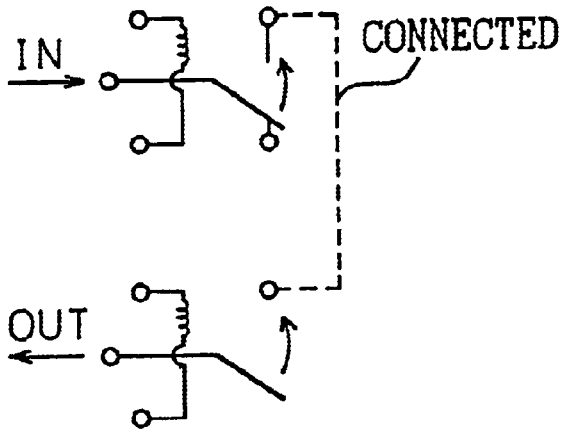
Fig.18 PRIOR ART
FIG. 18 is a circuit diagram illustrating a prior art.
Figure 19:
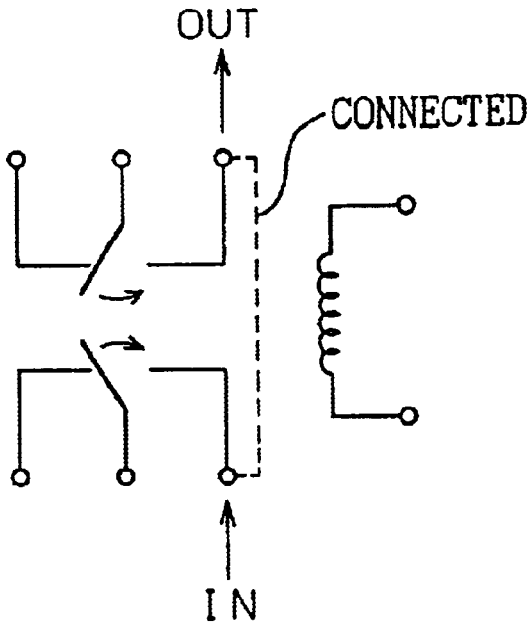
Fig.19 PRIOR ART
FIG. 19 is a circuit diagram illustrating a prior art.

Next, described below is the attachment of the contact element to the first fixed contact terminal 51 in each of the embodiments. FIG. 17*a* is a diagram illustrating a portion of the first fixed contact terminal 51 of a decreased thickness and to which the contact element 51*a* is affixed, as a rivet. FIG. 17*b* illustrates a conventional attachment. As will be obvious from the comparison of the two, an intermediate portion M of the contact element 51*a* in the embodiment of the invention is smaller than an intermediate portion M' that is attached according to the prior art, and reduces the material cost.

What is claimed is:

1. An electromagnetic relay comprising:

a first fixed contact terminal and a second fixed contact terminal spaced from each other on a first main surface of a base block;

fixed conductor pieces of a number n−1 mounted in adjacent, spaced relationship on said one surface of said base block in alignment with, and between, the first fixed contact terminal and the second fixed contact terminal; and an L-type yoke affixed to the base and having a first leg transverse to the first main surface of the base in a second leg extending parallel to and spaced from the first main surface and a coil mounted therebetween having a axis parallel to the first main surface;

an armature and a generally L-shaped spring having a first leg portion, a central mounting portion secured to a central portion of an outer surface of the armature and resiliently displacing the armature from the coil and a second leg portion comprising at least one moving conductor piece, in a number n, supported by the cantilevered spring member portion and simultaneously moved with the armature by energization of the coil mounted on said base block, for connecting the first fixed contact terminal, the second fixed contact terminal and the two adjacent fixed conductor pieces simultaneously in a series circuit relationship, a central, extension portion of the spring, integral with the central portion thereof, extending to and engaging an upper portion of the outer surface of the armature; wherein:

the first fixed contact terminal and the second fixed contact terminal are connected together through serially arranged contact sets of a number 2n formed by the first fixed contact terminal, the second fixed contact terminal, the fixed conductor pieces of the number n−1 and the moving conductor pieces of the number n, and n is an integer not smaller than 2.

2. An electromagnetic relay according to claim 1, wherein a third fixed contact terminal is provided facing the first fixed contact terminal with the moving conductor pieces sandwiched therebetween, and a fourth fixed contact terminal is provided facing the second fixed contact terminal with the moving conductor pieces sandwiched therebetween, the first fixed contact terminal serving as a make terminal, the third fixed contact terminal serving as a break terminal, and the second fixed contact terminal and the fourth fixed contact terminal conductive to each other serving as a common terminal.

3. An electromagnetic relay according to claim 1, wherein the number of the coils is one.

4. An electromagnetic relay according to claim 1, wherein the moving conductor pieces have a branched shape on the side on where they come in contact with the first fixed contact terminal, the second fixed contact terminal and the adjacent and spaced fixed conductor pieces.

5. An electromagnetic relay according to claim 1, wherein the moving conductor pieces are supported by the spring member via an electrically insulating member.

6. An electromagnetic relay according to claim 1, further comprising a stopper which the moving conductor pieces contact, defining their positions when the coil is not excited, the stopper being molded with a resin integrally with the base block.

7. An electromagnetic relay according to claim 1, wherein contact elements are attached to the portions of the first and second fixed contact terminals, of the third and fourth fixed contact terminals, of the fixed conductor pieces and of the moving conductor pieces that come in contact with one another, the contact elements protruding toward the contacting side, and the regions of the members to where the contact elements are attached have a decreased thickness on the side on where the contact elements are caulked.

8. An electromagnetic relay according to claim 1, wherein the coil is one obtained by arranging an iron core on the inside of a cylindrical portion of a bobbin that has a plate portion and the cylindrical portion and by arranging a coiled conductor on the outer side of the cylindrical portion, the bobbin is secured to the base block with its plate portion being inserted in a hole formed in the base block and with its hook formed on the plate member being engaged with the base block, and the coiled conductor is connected to a terminal of the coil mounted on the base plate via a conductor member for the coil, the conductor member for the coil being insert-molded in the bobbin.

9. An electromagnetic relay according to claim 8, wherein the first and second fixed contact terminals or the third and fourth fixed contact terminals and coil terminals are formed by machining an electrically conducting plate memeber integrally with the lead terminals which protrude from the other surface of the base block and to which the external conductors are connected, and are, then, insert-molded in the base block.

10. An electromagnetic relay according to claim 9, wherein there are provided a pair of terminals each having a slot, and a protection element is mounted with its both ends being inserted in the pair of slots.

11. An electromagnetic relay according to claim 2, wherein:

contact elements are attached to the portions of the first and second fixed contact terminals, of the third and fourth fixed contact terminals, of the fixed conductor pieces and of the moving conductor pieces so as to protrude toward the side of the contact surface;

the angle of the moving conductor pieces, relative to the vertical line, when they come into contact with the first and second fixed contact terminals, is different from the angle of the moving contact pieces, relative to the vertical line, when they come into contact with the third and fourth fixed contact terminals;

the contact elements of the moving conductor pieces that come into contact with the contact elements of the first and second fixed contact terminals and the contact elements of the moving conductor pieces that come in contact with the contact elements of the third and fourth fixed contact terminals, are located at an equal distance from the center of movement of the moving pieces; and a height of the contact elements of the third and fourth fixed contact terminals from the base block is different from a height of the contact elements of the first and second fixed contact terminals from the base block, so that the contact elements of the moving conductor pieces come in contact with the contact element of the first fixed contact terminal and with the contact element of the third fixed contact terminal at their centers and come in contact with the contact element of the second fixed contact terminal and with the contact element of the fourth fixed contact terminal at their centers.

12. An electromagnetic relay according to claim 1, wherein plural contact sets are closed and opened within a predetermined period of time.

13. An electromagnetic relay according to claim 2, wherein plural contract sets are closed and opened within a predetermined period of time.

14. An electromagnetic relay according to claim 2, wherein contact elements are attached by caulking to the portions of the first and second fixed contact terminals, of the third and fourth fixed contact terminals, of the fixed conductor pieces and of the moving conductor pieces that come in contact with one another, the contact elements protruding toward the contacting side, and the regions of the members to which the contact elements are caulked have a decreased thickness on the side on which the contact elements are caulked.

15. An electromagnetic relay according to claim 2, wherein the coil is one obtained by arranging an iron core on the inside of a cylindrical portion of a bobbin that has a plate portion and the cylindrical portion and by arranging a coiled conductor on the outer side of the cylindrical portion, the bobbin is secured to the base block with its plate portion being inserted in a hole formed in the base block and with its hook formed on the plate member being engaged with the base block, and the coiled conductor is connected to a terminal of the coil mounted on the base plate via a conductor member for a coil, the conductor member for coil being insert-molded in the bobbin.

16. An electromagnetic relay according to claim 1, wherein the outer surface of the armature has a stepped configuration at the juncture of the central portion and the lower portion whereby the lower portion of the spring member is displaced from the lower portion of the outer surface of the armature.

17. An electromagnetic relay according to claim 1, wherein the first leg portion, the central portion, the extension therefrom and the second leg portion of the spring comprises a single unitary structure.

18. An electromagnetic relay according to claim 2, wherein the spring member comprises a first element including the first leg portion and an integral and unitary end extension and a second element comprising an end extension overlapping the end extension of the first member and together comprising the central portion secured to the armature and a second leg portion comprising the moving conductor piece.

19. An electromagnetic relay according to claim 18, further comprising an insulating layer separating the respective end portions of the first and second spring members.

20. An electromagnetic relay comprising:

a first fixed contact terminal and a second fixed contact terminal spaced from each other on a first main surface of a base block;

fixed conductor pieces of a number n mounted in adjacent, spaced relationship on said one surface of said base block in alignment with, and between, the first fixed contact terminal and the second fixed contact terminal; and an L-type yoke affixed to the base and having a first leg affixed to, and extending transverse to, the first main surface of the base and a second leg extending parallel to and spaced from the first main surface and having a free end and a coil mounted therebetween having a axis parallel to the first main surface and extending to the free end of the second leg of the yoke;

an armature and a generally L-shaped spring providing a cantilevered, resiliently biased support of the armature from the free end of the second leg of the yoke, normally displaced from the coil and movable by energization of the coil for rotation about the free end of the second leg of the yoke and toward the coil, against the resilient bias of the spring, for connecting the first fixed contact terminal, the second fixed contact terminal and the two adjacent fixed conductor pieces simultaneously in a series circuit relationship, the spring having a first leg portion secured to the first leg of the yoke, a pair of spaced, folded portions extending from the first leg portion and over the free end of the yoke and an upper portion of the armature, connecting at respective fold lines to corresponding, laterally spaced portions of a central portion of the spring, the central portion contacting and being secured to the central portion of the armature and including a stabilizing extension portion between the fold lines and disposed on the upper portion of the armature and a lower portion extending from the central portion and carrying thereon the moving conductor pieces in a number n:

the first fixed contact terminal and the second fixed contact terminal are connected together through serially arranged contact sets of a number 2n formed by the first fixed contact terminal, the second fixed contact terminal, the fixed conductor pieces of the number n−1 and the moving conductor pieces of the number n, and n is an integer not smaller than 2.

21. An electromagnetic relay according to claim 20, wherein a third fixed contact terminal is provided facing the first fixed contact terminal with the moving conductor pieces sandwiched therebetween, and a fourth fixed contact terminal is provided facing the second fixed contact terminal with the moving conductor pieces sandwiched therebetween, the first fixed contact terminal serving as a make terminal, the third fixed contact terminal serving as a break terminal, and the second fixed contact terminal and the fourth fixed contact terminal conductive to each other serving as a common terminal.

22. An electromagnetic relay according to claim 20, wherein the moving conductor pieces have a branched shape on the side on where they come in contact with the first fixed contact terminal, the second fixed contact terminal and the adjacent and spaced fixed conductor pieces.

23. An electromagnetic relay according to claim 20, wherein the moving conductor pieces are supported by the spring member via an electrically insulating member.

24. An electromagnetic relay according to claim 20, further comprising a stopper which the moving conductor pieces contact, defining their positions when the coil is not excited, the stopper being molded with a resin integrally with the base block.

25. An electromagnetic relay according to claim 20, wherein contact elements are attached to the portions of the first and second fixed contact terminals, of the third and fourth fixed contact terminals, of the fixed conductor pieces and of the moving conductor pieces that come in contact with one another, the contact elements protruding toward the contacting side, and the regions of the members to where the contact elements are attached have a decreased thickness on the side on where the contact elements are caulked.

26. An electromagnetic relay according to claim 20, wherein the coil is one obtained by arranging an iron core on the inside of a cylindrical portion of a bobbin that has a plate portion and the cylindrical portion and by arranging a coiled conductor on the outer side of the cylindrical portion, the bobbin is secured to the base block with its plate portion being inserted in a hole formed in the base block and with its hook formed on the plate member being engaged with the base block, and the coiled conductor is connected to a terminal of the coil mounted on the base plate via a conductor member for the coil, the conductor member for the coil being insert-molded in the bobbin.

27. An electromagnetic relay according to claim 26, wherein the first and second fixed contact terminals or the third and fourth fixed contact terminals and coil terminals are formed by machining an electrically conducting plate member integrally with the lead terminals which protrude from the other surface of the base block and to which the external conductors are connected, and are, then, insert-molded in the base block.

28. An electromagnetic relay according to claim 27, wherein there are provided a pair of terminals each having a slot, and a protection element is mounted with its both ends being inserted in the pair of slots.

29. An electromagnetic relay according to claim 20, wherein plural contact sets are closed and opened within a predetermined period of time.

30. An electromagnetic relay according to claim 20, wherein plural contact sets are closed and opened within a predetermined period of time.

31. An electromagnetic relay according to claim 20, wherein the outer surface of the armature has a stepped configuration at the juncture of the central portion and the lower portion whereby the lower portion of the spring member is displaced from the lower portion of the outer surface of the armature.

32. An electromagnetic relay according to claim 21, wherein the spring member comprises a first element including the first leg portion and an integral and unitary end extension and a second element comprising an end extension overlapping the end extension of the first member and together comprising the central portion secured to the armature and a second leg portion comprising the moving conductor piece.

33. An electromagnetic relay according to claim 32, further comprising an insulating layer separating the respective end portions of the first and second spring members.

34. An electromagnetic relay according to claim 1, wherein the lower portion of the spring comprises a pair of spaced, parallel arms carrying respective, moving contact elements.

35. An electromagnetic relay, comprising:

an insulating base having a main surface;

first and second fixed contacts, supported on the main surface of the insulating base, spaced apart from each other along an axis and having contact elements disposed substantially transversely to the insulating base main surfaces; and a cantilevered spring member of first and second arm portions integrally connected by a pair of laterally spaced folded portions in an L-shaped configuration, the first arm being supported by the insulating base so as to extend parallel thereto;

a coil disposed between the first spring member and the main surface and having an active end;

the second arm portion being connected to a surface of, and carrying thereon, an armature, the second arm portion having an integral extension, disposed intermediate the pair of laterally spaced folded portions, extending to, and disposed on, an upper portion of the armature surface relatively to the connection of the second arm to the armature surface, the second arm being rotated relatively to the first arm about a second axis parallel to the first axis against the resilient biasing thereof upon energization of the coil; and the second arm carrying first and second movable contacts adjacent a free end thereof which move by the rotation of the second arm, from positions displaced from, to positions electrically contacting, the first and second fixed contacts, the second arm of the cantilevered spring member electrically, serially connecting the first and second fixed contacts when engaged by the respective, first and second movable contacts.

36. The electromagnetic relay as recited in claim 35, wherein:

the plural fixed contacts comprise first and second, electrically non-connected contact terminals having respective contact surfaces; and the plural movable contact surfaces comprise first and second electrically connected movable contact surfaces which contact the respective fixed contact surfaces respectively of the first and second electrically non-connected contact terminals and the movable contacts electrically serially interconnect same.

37. The electromagnetic relay as recited in claim 35, wherein:

the plural fixed contacts further comprise third and fourth serially electrically connected contact surfaces aligned with and disposed between the respective contact terminals of the first and second electrically non-connected contact terminals; and the plural movable contact surfaces comprise first and second pairs of electrically interconnected movable contact surfaces, the first pair electrically contacting and serially interconnecting the first and third fixed contacts and the second pair electrically contacting and serially interconnecting the second and fourth fixed contact surfaces.

38. The electromagnetic relay as recited in claim 35, wherein:

each movable contact and respective fixed contact element electrically contacted thereby, together, define a contact set.

39. The electromagnetic relay as recited in claim 35, wherein:

the plural fixed contacts further comprise a fixed contact element having a pair of fixed contact surfaces aligned on the third axis and spaced between the respective fixed contact surfaces of the first and second fixed contacts; and the movable contact further comprises a further pair of electrically connected contact surfaces spaced along the second axis; and the first pair of movable contact surfaces electrically contact the respective fixed contact surfaces of the first fixed contact and the adjacent fixed contact of the fixed contact element and the movable contact electrically connecting same in series and the second pair of movable contact surfaces electrically contacting the respective fixed contact surfaces of the second fixed contact and the adjacent fixed contact surface of the fixed contact element and the movable contact electrically connecting same in series.

40. An electromagnetic relay, comprising:

an insulating base;

first and second fixed contacts having respective fixed contact surfaces and (n−1) fixed conductor elements separating the first and second fixed contacts and each having a pair of respective fixed contact surfaces, the first and second fixed contacts being supported on a main surface of an insulating base and spaced from each other along a first axis;

a cantilevered spring member of an L-shaped configuration in a rest condition and defining first and second arm portions, the first arm portion being supported by the base and the second arm portion being rotatable relatively to the first arm portion about a second axis, parallel to the first axis, and carrying (n) moveable contacts thereon adjacent a free end thereof and aligned along a third axis, parallel to the first and second axes, the first and third axes being spaced by a common distance from the second axis;

each movable contact comprising a pair of electrically connected, movable contact surfaces;

a coil mounted on the insulating base and, when electrically energized, rotating the second arm portion relatively to, and toward, the first arm portion, against a resilient force of the cantilevered spring member, and thereby moving the (n) movable contacts from positions displaced from, to positions electrically contacting, respective fixed contact surfaces, each pair of adjacent movable contacts electrically contacting and serially connecting a respective pair of fixed contact surfaces; and n is a positive integer not smaller than two.

41. The electromagnetic relay as recited in claim 40, wherein the fixed contact surfaces are disposed substantially transversely to the insulating base.

42. The electromagnetic relay as recited in claim 40, wherein:

the first and second fixed contacts respectively comprise first and second, electrically non-connected contact elements.

43. The electromagnetic relay as recited in claim 40, wherein:

each of the first and second movable contacts comprises a respective pair of movable contact elements;

the respective pair of movable contact elements of the first movable contact electrically contact the respective, and adjacent, fixed contact elements of the first fixed contact and the adjacent fixed contact element of the fixed conductor element and the same are serially connected by the first movable contact; and the respective pair of movable contact elements of the second movable contact electrically contact the respective, and adjacent, fixed contact elements of the second fixed contact and the adjacent fixed contact element of the fixed conductor element and the same are serially connected by the second movable contact.

44. The electromagnetic relay as recited in claim 43, wherein:

the plural fixed contacts further comprise third and fourth serially electrically connected contact elements; and the plural movable contacts comprise first and second adjacent pairs of movable, electrically connected contacts, respectively serially connecting the first and the third fixed contacts and the fourth and the second fixed contacts when electrically contacting same.

45. The electromagnetic relay as recited in claim 40, wherein:

each movable contact and a respective fixed contact element, electrically contacted thereby, together define a contact set.

* * * * *

UNITED STATES PATENT AND TRADEMARK OFFICE

CERTIFICATE OF CORRECTION

PATENT NO. : 6,677,840 B2
DATED : January 13, 2004
INVENTOR(S) : Akihiko Nakamura et al.

It is certified that error appears in the above-identified patent and that said Letters Patent is hereby corrected as shown below:

Title page,
Item [56], References Cited, FOREIGN PATENT DOCUMENTS, insert

| | | |
|---|---|---|
| -- 0 382 525 A1 | 08/1990 | European Patent Office |
| SU 686091 A | 09/1979 | USSR |
| 2 257 832 A | 01/1993 | Great Britain |
| 2 335 029 | 07/1977 | France -- |

Signed and Sealed this

Eleventh Day of January, 2005

JON W. DUDAS
*Director of the United States Patent and Trademark Office*